US007413378B2

(12) United States Patent
Way

(10) Patent No.: US 7,413,378 B2
(45) Date of Patent: Aug. 19, 2008

(54) BOAT LIFT

(76) Inventor: Robert L. Way, 4505 8th St., Court E, Ellenton, FL (US) 34222

( * ) Notice: Subject to any disclaimer, the term of this patent is extended or adjusted under 35 U.S.C. 154(b) by 178 days.

(21) Appl. No.: 11/134,912

(22) Filed: May 23, 2005

(65) Prior Publication Data

US 2006/0263148 A1 Nov. 23, 2006

(51) Int. Cl.
*B63C 3/06* (2006.01)

(52) U.S. Cl. ..... 405/4; 114/44; 405/7

(58) Field of Classification Search ..... 405/3
See application file for complete search history.

(56) References Cited

U.S. PATENT DOCUMENTS 4,773,346 A * 9/1988 Blanding et al. ..... 114/45
4,973,094 A * 11/1990 Tana et al. ..... 294/81.21
5,002,000 A * 3/1991 Rutter ..... 114/45
6,695,533 B1 * 2/2004 Bulmann ..... 405/3
6,709,197 B1 * 3/2004 Sargent et al. ..... 405/3
7,066,683 B2 * 6/2006 Way ..... 405/3
2002/0150427 A1 * 10/2002 Godbersen ..... 405/3

* cited by examiner

*Primary Examiner*—Tara L. Mayo
(74) *Attorney, Agent, or Firm*—Arthur G. Yeager

(57) ABSTRACT

A boat lifting assembly includes a cradle for carrying a boat mounted between three pilings on each cradle side. A pair of support housings is affixed to the pilings on each cradle side. A pair of hydraulic lifts are housed in the housings and connected to the cradle for moving same vertically. Each lift includes a horizontally extensible piston carrying a piston pulley block and a stationary hydraulic cylinder. Three cables have one end portion threaded between the pulleys of the block and the cradle. Transition pulleys are supported by the housing and direct the cable vertically for moving the cradle when the block is moved. Additional pulleys and various anchor points may be employed to provide for vertical lifts of 1.5, 2.0 and 3.0 times the distance of movement of the piston. The housings are in the same plane as the cradle deck and/or dock.

22 Claims, 13 Drawing Sheets

BOAT LIFT

CROSS REFERENCE TO RELATED APPLICATIONS

This application is related to U.S. application Ser. No. 10/659,516, entitled BOAT LIFT, filed Sep. 11, 2003 by the present applicant.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates to a boat lift and, more particularly, to a hydraulically operated boat lift including a plurality of pulleys for raising and lowering a boat along two pilings.

2. Relevant Art

A multiplicity of boat lifts have been employed by prior art for docking vessels or lifting them out of the water for servicing. One type of such boatlifts is hydraulically operated by a plurality of pulleys and cables. However, conventional hydraulic boat lifts employing such pulleys and cables typically require unsightly overhead steel construction and are free standing, i.e. not secured to a dock, as illustrated in FIG. 1 of published U.S. Patent Application No. 2002/0150427 and U.S. Pat. No. Re. 32,118 both to Godbersen, for example.

As a result, such boat lifts must be supported by four pilings and require a large amount of space for allowing a boat to maneuver therebetween. In addition, such boatlifts typically position their mechanical/electrical components at heights well above an operator's reach thereby making access to such components difficult. None of the prior art lifts are desired.

In view of the foregoing background, it is therefore an object of the present invention to provide a hydraulically operated boat lift supportable by only two pilings with readily accessible components.

BRIEF SUMMARY OF THE INVENTION

In one aspect of the present invention there is provided an assembly for lifting a boat including a cradle for carrying a boat, a plurality of spaced vertically disposed pilings on each side of the cradle, each piling having a lower portion mounted into a floor of a body of water and an upper portion extending thereabove; a pair of support housings affixed to upper portions of the plurality of pilings on each side of the cradle. A pair of lifting means are housed in and mounted on the support housing and connected to the cradle for moving the cradle vertically, each lifting means including a horizontally extensible piston carrying a piston pulley block at its forward end, a stationary hydraulic cylinder mounted to the housing, and cable means having one end portion threaded around the pulley block and another end portion connected to the cradle. Transition pulley means are supported by the housing and carry a portion of the cable means to direct another end portion of the cable means vertically for moving the cradle when the piston pulley block is moved horizontally by the piston, and hydraulic control means for operating each hydraulic cylinder. The cradle includes three spaced structural members having opposite end portions and extending laterally of the cylinder and piston, the cable means includes three cables, each cable having a first end attached to an end portion of the member and another end portion threaded around the piston pulley block and affixed to the housing. One member is disposed adjacent and below a stern of a boat carried by the cradle, a second member is disposed adjacent and below amidships of a boat carried by the cradle, and a third member is disposed adjacent and below a bow of a boat carried by the cradle. Each transition pulley means includes a down bow pulley, a down amidships pulley, and a down stern pulley, each down pulley being disposed vertically to dispose an axis of rotation of each down pulley horizontally. Each housing includes a lower wall, each lower wall of the housing has spaced slots, each down pulley being mounted with its axis horizontal and extending partially through the slot with its axis in the housing. Each piston pulley block includes three piston pulleys, each piston pulley being mounted horizontally to dispose an axis of rotation of the piston pulley vertically.

In another aspect of the present invention there is provided motion-sensing means for determining the distance of rotation of one down pulley of each lifting means and providing an output signal indicative of such measured distance of rotation. The control circuit means receives the output signals for operating the hydraulic control means in response to the difference between the control signals.

In a further aspect of the present invention there is provided an assembly for lifting a boat comprising a cradle for carrying a boat, three vertically disposed pilings on each side of the cradle and the pair of support housings are each affixed to the upper portion of each respective piling. Each cable is threaded around the pulley block and connected to the cradle to provide that the cradle end of each cable moves vertically twice the distance of the movement of the pulley block by said piston. Also included are three redirect pulleys mounted in a fixed position on each housing, each cable having one end portion affixed to the cradle and another end portion affixed to the pulley block, each cable being threaded around the pulleys of the pulley block and a redirect pulley to provide that the cradle moves three times the distance of movement of the pulley block by the hydraulic means. Alternately, three redirect pulleys are mounted in a fixed position on each housing, each cable having one end portion affixed with respect to the housing and another end portion affixed to the pulley block, three cradle pulleys mounted on each side of the cradle, each cable being threaded around the pulleys of the pulley block and a respective redirect pulley and respective cradle pulley to provide that the cradle moves one and one half times the distance of movement of the pulley block by the hydraulic means.

In a further aspect of the invention there is provided an assembly for lifting a boat comprising a cradle for carrying a boat, a plurality of spaced vertically disposed pilings on each side of the cradle, each piling having upper and lower end portions with the upper end portions being located above water at a predetermined height, a pair of elongated support housings being affixed to respective the upper portion of the plurality of the pilings on each side of the cradle, a pair of hydraulic lifting means disposed in respective housing for moving the cradle upwardly and downwardly, each hydraulic lifting means including a cylinder affixed to the housing and a movable piston, a plurality of pulleys and a plurality of cables, the cylinder and piston moving in a substantially horizontal direction, the cradle including a deck part substantially horizontally aligned with a dock, and the housings having an upper wall substantially parallel to and parallel with the deck part of said cradle.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
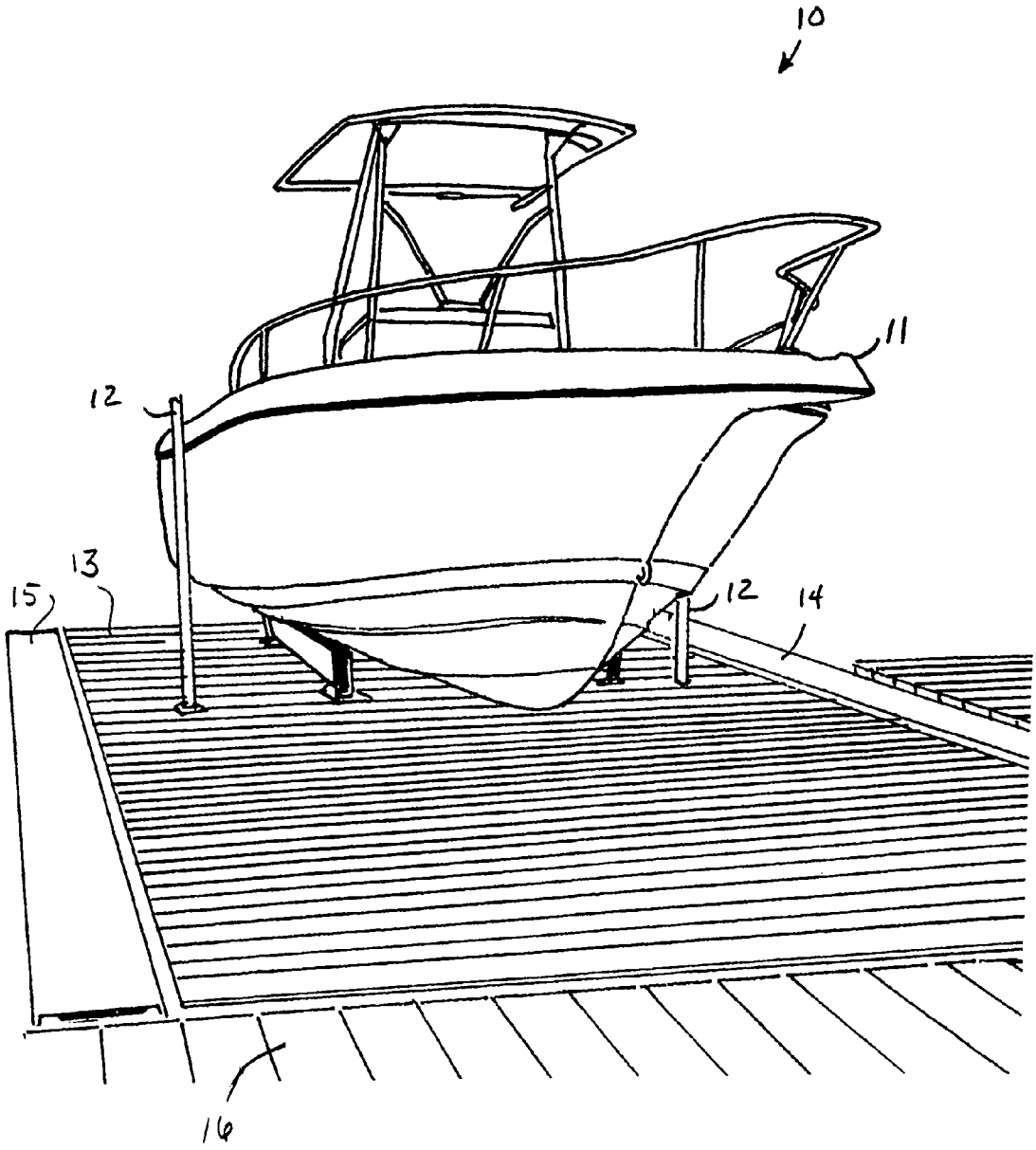
FIG. 1 is a perspective view of the boat lift according to the present invention.

The boat lift 10 design (FIG. 1) is based on a hydraulically operated Cable-Handling Unit or "CHU" that "shortens" the lifting cables as opposed to "winding" the cable on a rotating drum or pipe.

The use of a hydraulic cylinder ensures that the maximum amount of cable "gathered" or "released" is determined by the physical length of the cylinder rod stroke. This relationship never changes. Maximum lift travel is therefore not dependent on the use of a mechanical limit switch or similar devices.

This feature is what a lift 10 is dependent on. Because the possibility of crashing, or "two-blocking" the moving apparatus against the non-moving machinery is impossible, the typical safety margin of 16 to 18 inches between these two elements can be reduced to less than 1 inch.

Figure 2:
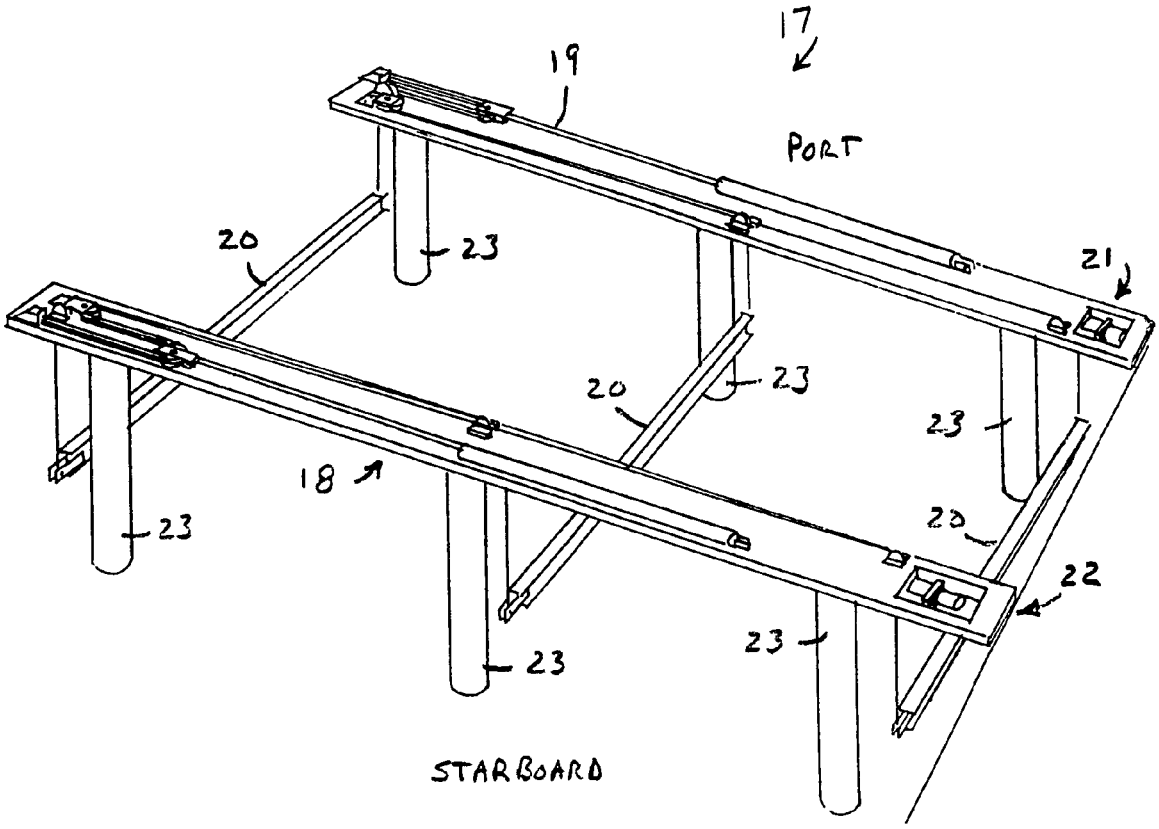
FIG. 2 is a perspective view of the various components of the boat lift of FIG. 1 with sides and covers not shown.
Figure 5:
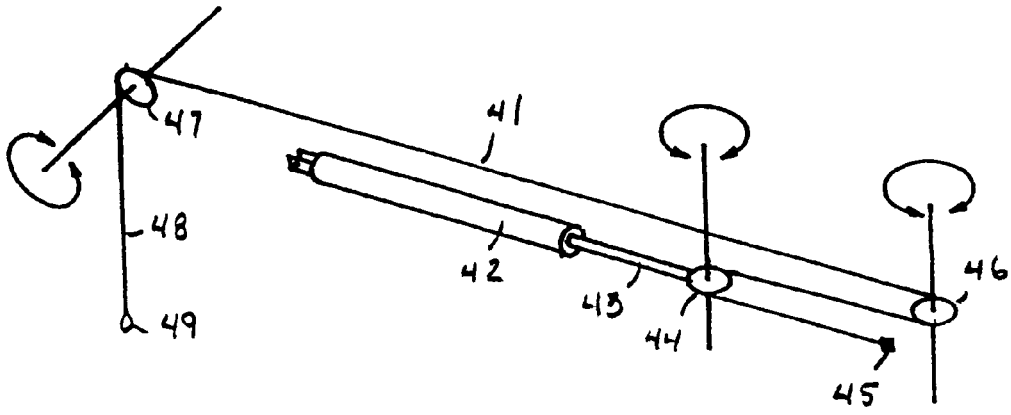
FIG. 5 is a motion diagram of the configuration of a third cable in accord with the present invention.
Figure 4:
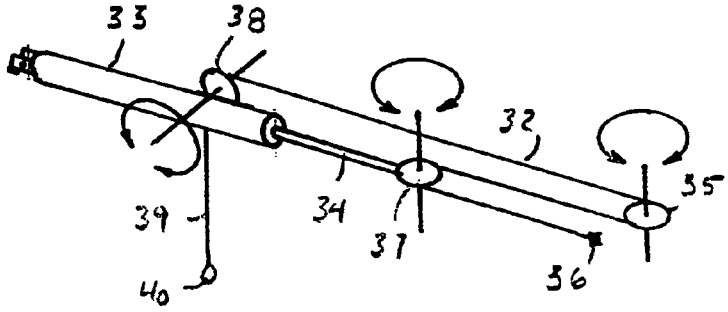
FIG. 4 is a motion diagram of the configuration of a second cable in accord with the present invention.
Figure 3:
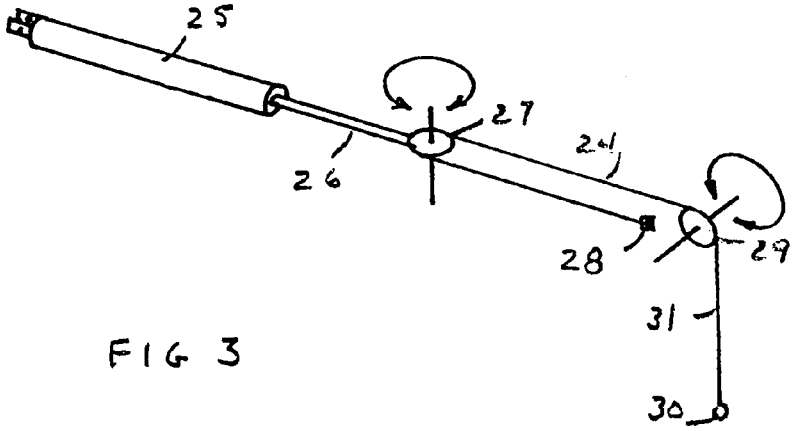
FIG. 3 is a motion diagram of the configuration of a first cable in accord with the present invention.
Figure 6:
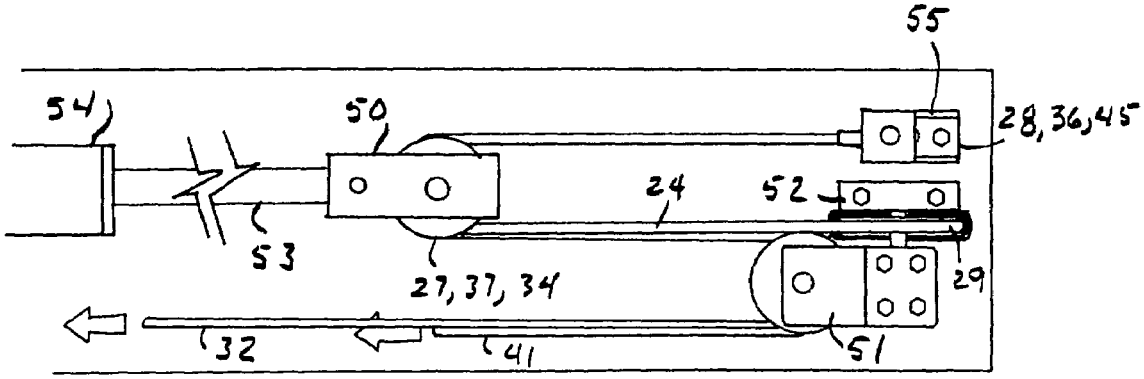
FIG. 6 is a top diagrammatic view of the cable connections and pulleys of FIGS. 3-5.
Figure 9:
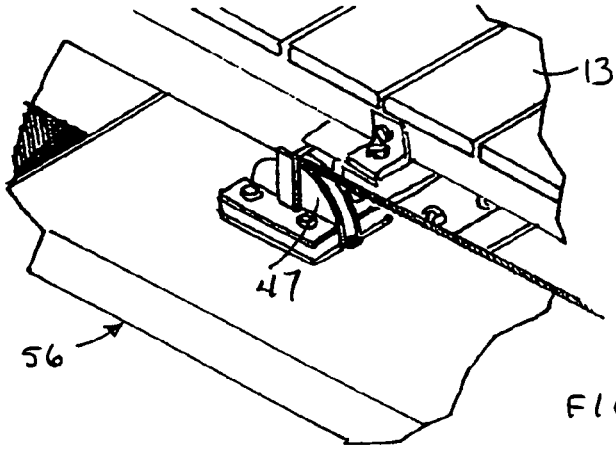
FIG. 9 is a perspective view of the forward down transition pulley of the port CHU.
Figure 8:
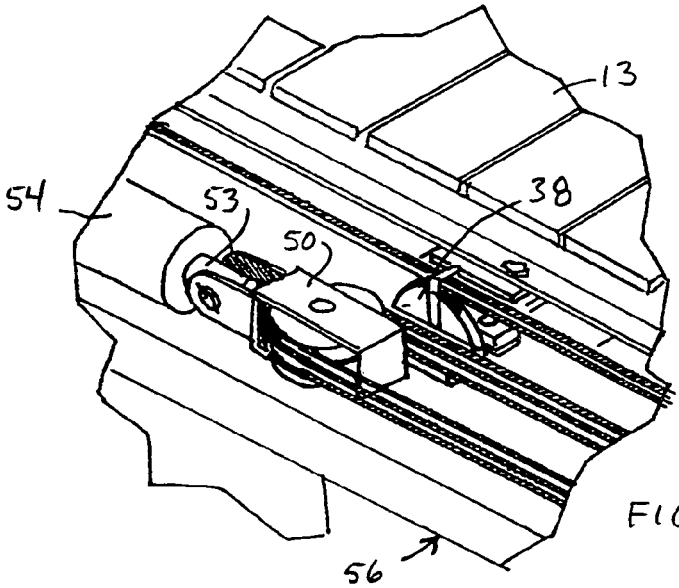
FIG. 8 is a perspective view of the amidships portion of the port CHU.
Figure 7:
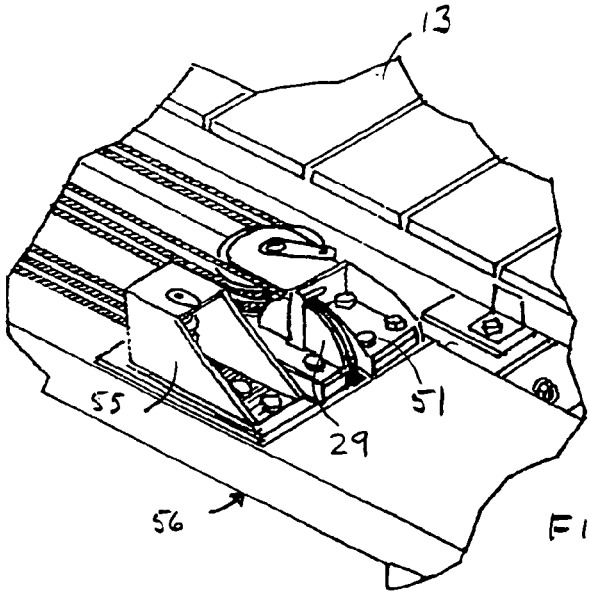
FIG. 7 is a perspective view of the mounting of the aft end of the port CHU.

The lift 10 is comprised of a starboard and port CHU shown generally at 15, 14. A moving deck or cradle structure of members 20 disposed athwartships below a boat, hydraulic power supplies 21 and 22 and six support pilings. Depending on the configuration, two or three cables are used on each CHU. FIG. 2 illustrates the CHU's 18, 19 of lift 17 in more detail. To facilitate explanation, only the starboard CHU 18 as configured for the "double pass" three-cable platform lift will be discussed.

Cable Routing

Cable routing for the CHU is shown in FIGS. 3-9. There are eight pulleys and three cables employed. Cable 24, the Stern Lift Cable (FIG. 3) uses two pulleys: one 180 degree wrap pulley 27 in the cylinder rod-end pulley block assembly and one 90 degree wrap "down transition" pulley 29, part of the main pulley block assembly.

Cable 32, the Amidships Lift cable (FIG. 4) utilizes three pulleys: One 180 degree wrap pulley 37 in the cylinder rod pulley block assembly, one 180 degree wrap pulley 35, part of the main pulley block assembly and one 90 degree wrap "down transition" pulley 38.

Cable 41, the Forward Lift Cable (FIG. 5), utilizes three pulleys: One 180 degree wrap pulley 44 in the cylinder rod-end pulley block assembly 42, 43, one 180 degree wrap pulley 46 in the main pulley block assembly, and one 90 degree wrap "down transition" pulley 47.

All cable stationary or "bitter-ends" are attached to the CHU cable anchor block 55 (FIG. 6) at points 28, 36, 45. Preferably, a single cylinder rod-end pulley 53, 54 is used to move platform 13 up and down.

The "free-ends" of cables 24, 32, and 41 are attached to the moving platform cross members 20.

In the "double-pass" configuration, the total platform travel is equal to 2× cylinder rod travel. A 6' cylinder rod stroke yields 12' of platform travel.

Figure 15:
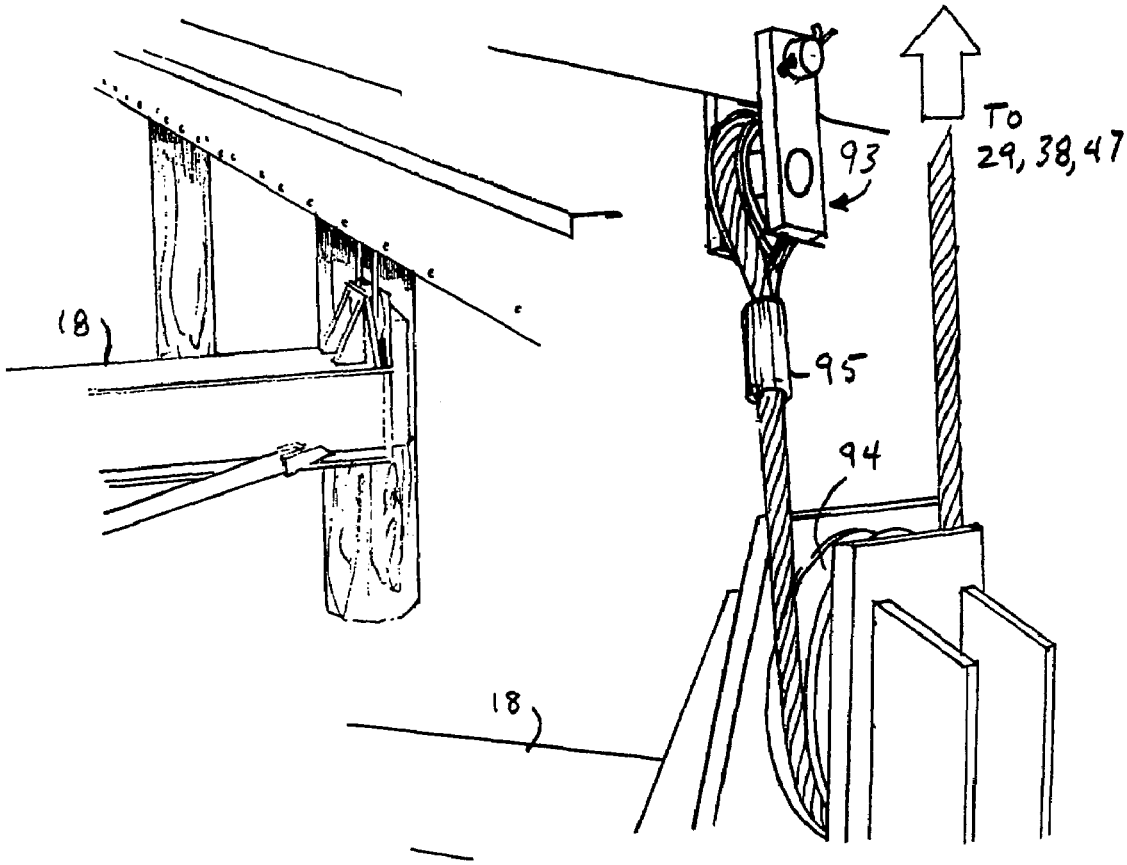
FIG. 15 is a detail of an alternate cable termination in accord with the present invention.

Observation of safe working limits on wire rope are the primary limitations of the hydraulic operated boat hoist. The easiest way to increase the lifting capacity of the lift is to run the free end of the lifting cable through an additional pulley installed on the platform cross-member. Attaching the free end to new purchase point 93 (FIG. 15) effectively reduces the load on the lifting cable by 50%. Although increases in lifting capacity are realized immediately, the length of cable gathered by the respective CHU 14, 15 is immediately reduced by 50%.

There are two ways to overcome the disadvantage of the cross-member mounted pulley.

1) Increase the length of the hydraulic cylinder.

2) Increase the number of pulleys in the CHU.

Increasing the length of the hydraulic cylinder rod by 1' increases the overall length of the extended cylinder and rod by 2'. To obtain 12' of travel as desired, a cylinder of 12' would be required. The disadvantages are obvious.

Increasing the number of pulleys within the CHU is a more feasible solution. A triple pass, 11-pulley CHU is shown in FIGS. 10-13. The primary difference is adding another set of redirect pulleys and moving the cable anchor from its stationary position, to the modified rod-end pulley block assembly. The triple pass, 11-pulley configuration provides an advantage of 3:1 (cable gathered: cylinder length).

Figure 12:
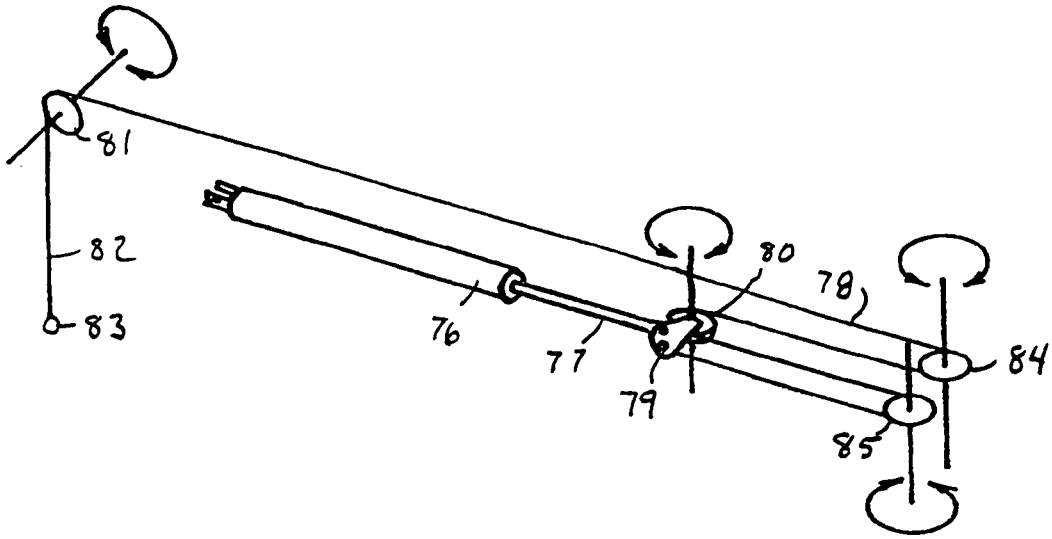
FIG. 12 is a motion diagram of the configuration of a third cable in accord with the embodiment of FIGS. 10 and 11.
Figure 11:
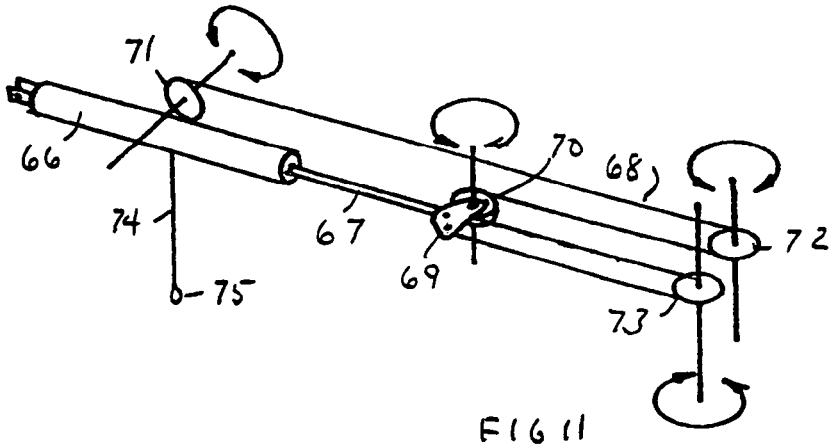
FIG. 11 is a motion diagram of the configuration of a second cable in accord with the embodiment of FIG. 10.
Figure 10:
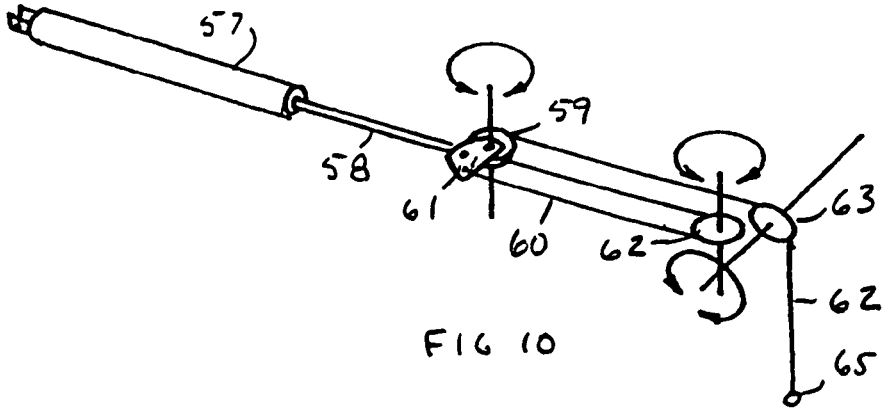
FIG. 10 is a motion diagram of the configuration of a first cable in accord with another embodiment of the invention.

FIGS. 10-12 illustrate the triple pass configuration. In FIG. 10, first cable 60 is wound around pulleys 63, 59 and redirect pulley 62 and is operated by cylinder/piston 57, 58. The rod end pulley 59 is carried by anchor point 61. Lift portion of cable 60 terminates in attachment bracket. Second cable 68 is wound around pulleys 70,71, 72 and redirect pulley 73 and is anchored at 69. Cylinder 66 operates rod 67 to control cable lift portion 74 terminating in attachment bracket 75. In FIG. 12 the third cable 78 is wound around pulleys 80, 81 and redirect pulleys 84, 85 and is anchored at 79. Cylinder/piston 76, 77 operates lift portion 82 of cable 78 having attached bracket 83.

Figure 13:
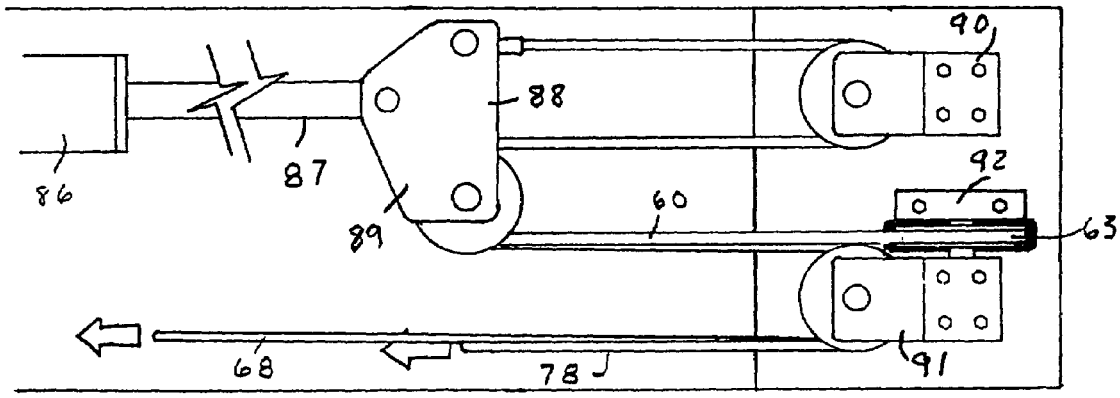
FIG. 13 is a top diagrammatic view of the cable connections and pulleys of FIGS. 10-12.
Figure 14:
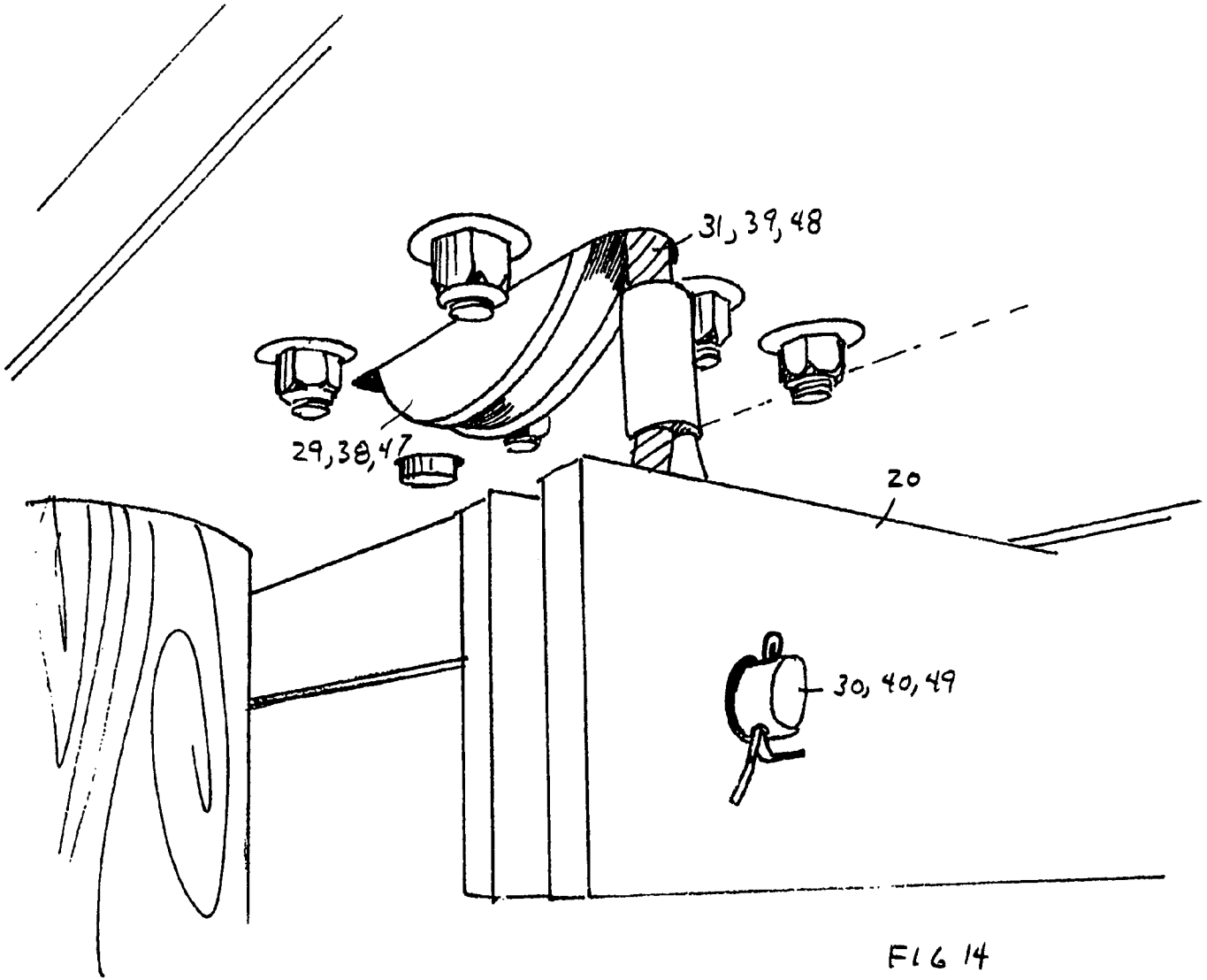
FIG. 14 is a detail of one embodiment of cable termination in accord with the present invention.

Preferably, as shown in FIG. 13, cable anchor 88 is the point of attachment (61, 69, 79) and is moved by a single cylinder/piston 86, 87 and pulley block 89 which carries pulleys 59, 70, 80. Fixed pulley block 90 carries pulleys 62, 73, 85 and fixed pulley block 91 carries pulleys 72, 73. Pulley 63 is mounted via block 92.

The primary disadvantage to this configuration is the increased load exerted on the main pulley block assembly 88 and the hydraulic cylinder 86, 87. On the double pass configuration, the cylinder must lift 2×0.5 total load. The triple pass configuration, the cylinder must lift 3×0.5 total load. When using the additional pulley on the lifting beam, the triple pass configuration cylinder load calculation can be expressed: 3×0.25 total load. Therefore, it becomes advantageous to utilize the triple pass configuration only when also utilizing the additional pulley cradle 94 installed on the platform cross-member (FIG. 15) via clamp 95 and post 93 which now becomes a 1.5:1 advantage.

Figure 18:
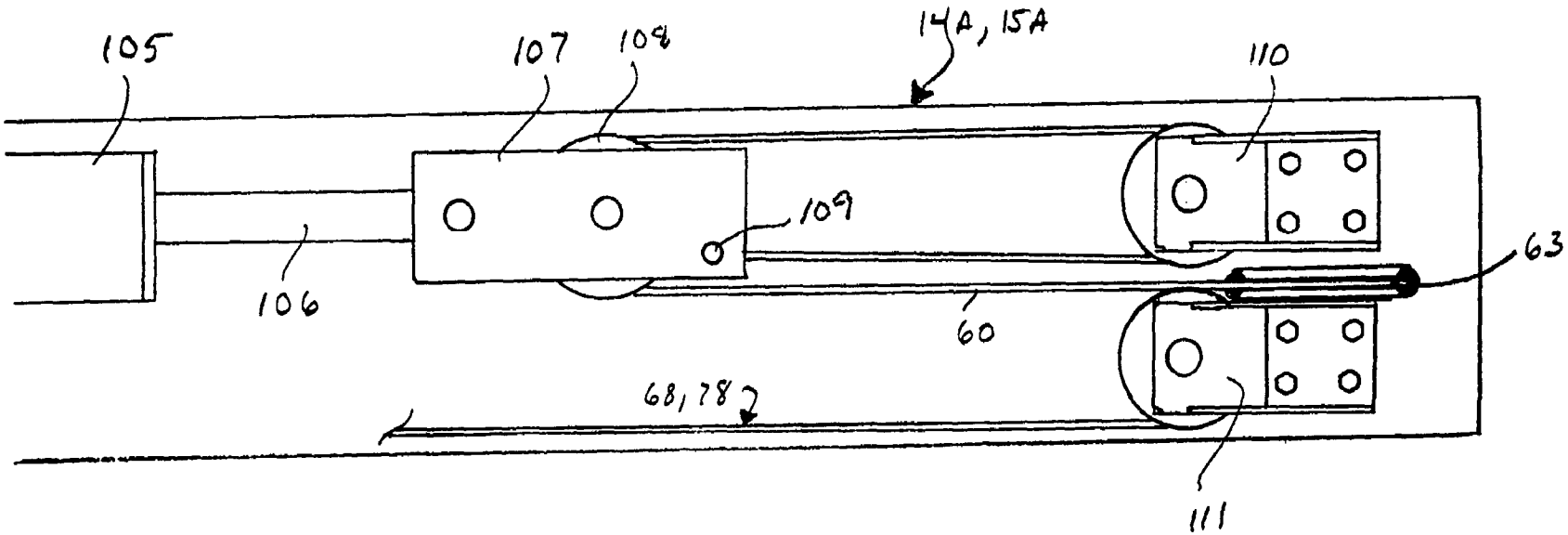
FIG. 18 illustrates an alternate routing of the cables in accord with the present invention.

FIG. 18 illustrates an alternate routing of the cables otherwise shown in FIG. 13. Cylinder 105 operates piston rod 106 to which rod end pulley block 107 which is narrower than the block 89 of FIG. 13. Pulley stack 108 is carried by block 107 and also includes cable anchor point 109.

Redirect pulley blocks 110 and 111 are substantially the same as blocks 90, 91 of FIG. 13. Pulleys 108 are preferably approximately 50% larger than the pulleys 62, 73, 85 and 72, 84 carried by blocks 91 and 90 respectively to allow for proper cable clearance with the narrower pulley block 107. In addition, the width of the CHU's 14A and 15A in this embodiment of the invention is less than CHU's 14, 15 discussed hereinabove.

Figure 19:
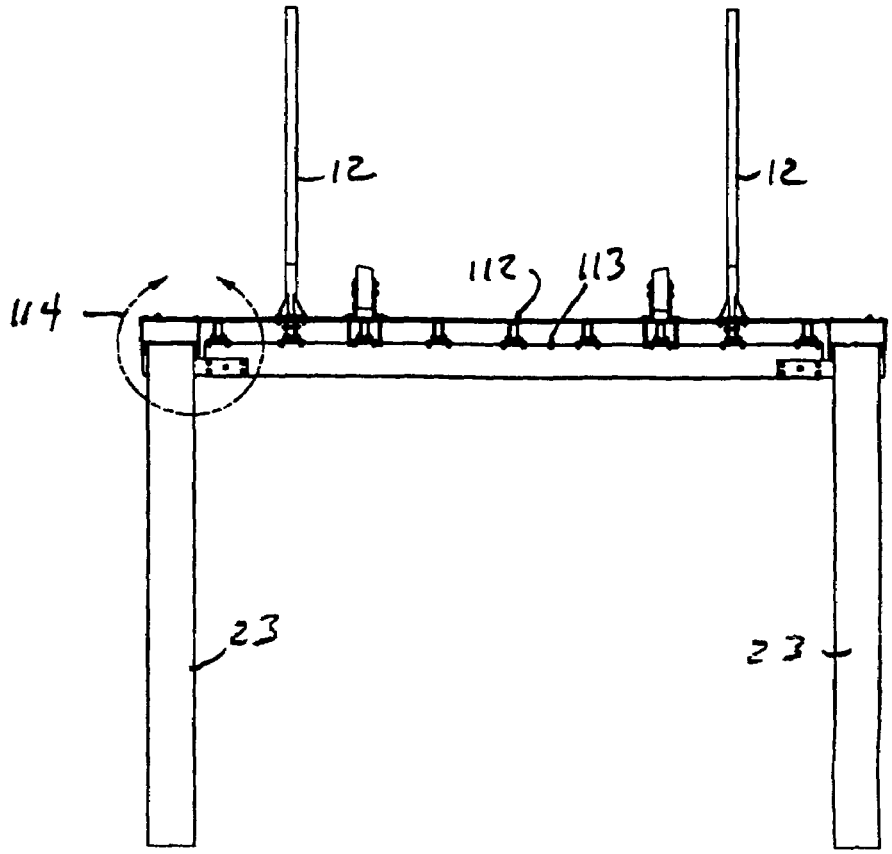
FIG. 19 is pictorial end view illustrating the relationship between the cable-handling units, boat platform and pilings in accord with the present invention.
Figure 20:
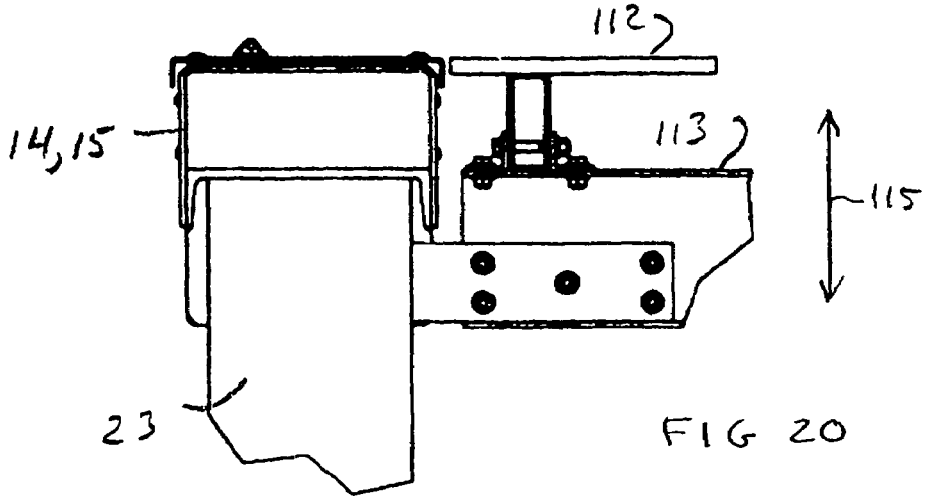
FIG. 20 is a detail of FIG. 19.

FIGS. 19 and 20 illustrate the platform 13 including upper surface deck 112 with members 113 and associated connectors as understood in the art. Area 114 is shown enlarged in FIG. 20. Vertical motion upwardly and downwardly is indicated at arrow 115. All construction materials and methods are chosen to be appropriate in the marine environment in which the lift is to be built and operated.

Closed Loop Feedback System

When utilizing two independent hydraulic drive mechanisms including pump 101, bypass valve 103 and control valve 102, a means of keeping the platform or cradle "level" from port to starboard as it travels from "stop to stop" can be done without interference (fully automatic) from the lift operator. The hydraulic lift automatic leveling system consists of four main parts:

1. Target Wheel: A ferrous metal sprocket 96 with 120 teeth or grooves around the 5.5" diameter periphery. The wheel is coupled to the side of the FORWARD WIRE down transition sheave via conventional bolts or other appropriate means (One each is mounted within the port/starboard CHU).

Figure 16:
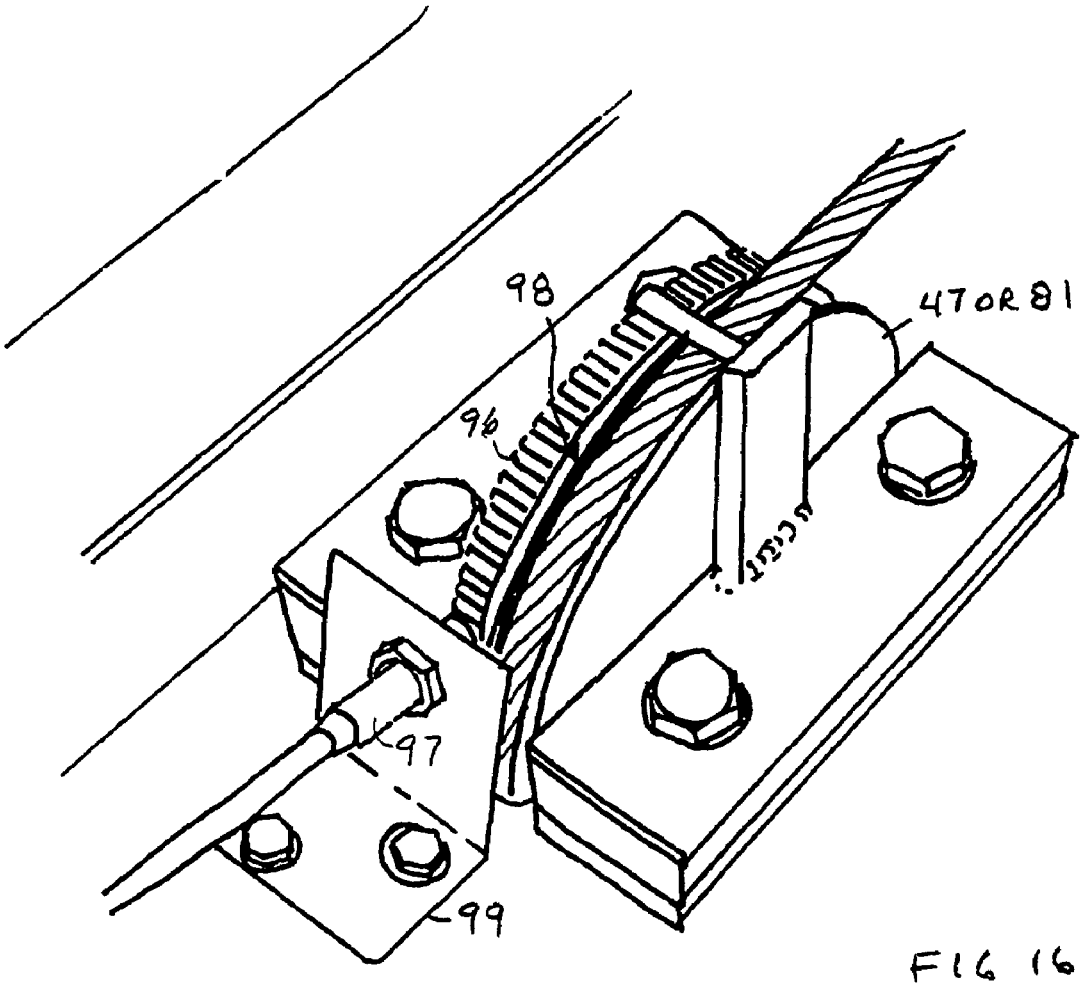
FIG. 16 is a perspective view of the pulley motion sensing apparatus in accord with the present invention.
Figure 17:
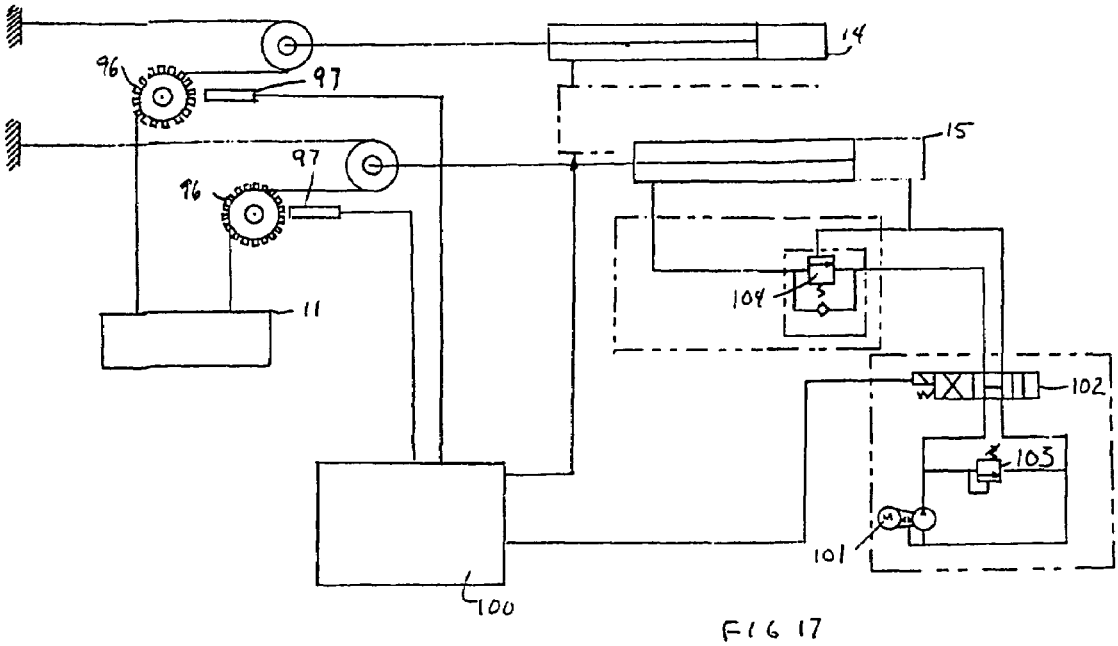
FIG. 17 is a block diagram of the feedback system that receives information from the apparatus of FIG. 16.

2. Proximity Sensor: "hall effect" 97 A device is mounted by bracket 99 (FIG. 16) used to read or "count" the "high spots" or teeth on the ferrous metal target wheel. As the rope sheave/target wheel rotates, 120 "couples pulses" are generated every complete revolution. This yields one pulse per 0.125" ($\frac{1}{8}^{th}$.") of rope travel.

3. Programmable Relay: An electronic device (micro controller PLC 100) is known to the art and is used to count pulses generated from each Cable Handling Unit (port/starboard target wheel 96). An uneven count (disparity) greater than five pulses between port and starboard target wheel represents an "out of tolerance" condition that is rectified in the form of "interruption" of CHU's drive solenoid. Simply, the side (port or starboard) that "leads is forced to stop briefly to "null" the error signal.

4. Directional Valves: Port and starboard directional valves 104 are the final component of the feedback subsystem. Whether traveling up or down, when an "out of tolerance" condition is detected, the directional valve 104 for the leading cylinder is forced by the PLC 100 to "center" (bypass fluid) for predetermined short intervals of a duration sufficient to "null" (reduce to zero), pulse disparity.

While the lift platform 13 is moving up or down, the "closed loop" feedback subsystem continuously monitors, compares and when necessary, corrects out of tolerance conditions instantaneously. In the event of "Auto Level Control" equipment failure, a means is provided to level the lift "manually" utilizing a push-button on the electronics cabinet. Note: An optical encoder can be used in place of the target wheel and proximity sensor.

The target wheel 96, proximity sensor 97 and directional valve 102 are contained within the respective CHU assembly. (Port/starboard) The PLC device 100 is contained within the electronic cabinet mounted on the dock structure.

In all embodiments, platform deck 112 is preferably flush with the surface of CHU's 14 and 15 and with the surface of dock 16. Pilings 23, units 14 and 15, cradle members 20 and the ultimate vertical movement of the apparatus are all of predetermined height and dimension for the location and intended use including the length and weight of the boat 11 to be lifted.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An assembly for lifting a boat comprising a cradle for carrying a boat;

a plurality of spaced vertically disposed pilings on each side of said cradle each said piling having a lower portion mounted into a floor of a body of water and an upper portion extending thereabove;

a pair of elongate support housings affixed to and along respective said upper portion of said plurality of said pilings on each side of said cradle;

a pair of independently controlled hydraulic lifting means respectively housed in and mounted on said support housing and connected to said cradle for moving said cradle vertically;

each said hydraulic lifting means including a horizontally extensible piston carrying a piston pulley block at its forward end, a stationary hydraulic cylinder mounted to said housing, and cable means having one end portion located in said housing and threaded around pulleys in said piston pulley block and another end portion connected to said cradle, transition pulley means spacedly supported by said housing and carrying a portion of said cable means to direct said another end portion of said cable means attached to said cradle vertically for moving said cradle when said piston pulley block is moved horizontally by said piston;

hydraulic control means for operating each said hydraulic cylinder, and said hydraulic control means including automatic leveling system for maintaining said cradle level from port to starboard when said cradle is moved vertically by said pair of hydraulic lifting means.

2. The assembly as defined in claim 1 wherein said cradle includes three spaced structural members having opposite end portions and extending laterally of said cylinder and piston, said cable means including three cables, each said cable having a first end attached to a respective said end portion of respective said member and another end portion threaded around said piston pulley block and affixed to said housing.

3. The assembly as defined in claim 2 wherein a first said member is disposed adjacent and below a stern of a boat carried by said cradle, a second said member is disposed adjacent and below amidships of a boat carried by said cradle, and a third said member is disposed adjacent and below a bow of a boat carried by said cradle, each said transition pulley means including a down bow pulley, a down amidships pulley, and a down stern pulley, each said down pulley being disposed vertically to dispose an axis of respective rotation of said down pulley horizontally.

4. The assembly as defined in claim 3 wherein each said housing includes a lower wall, each said lower wall of said housing including spaced slots, each said down pulley being mounted with its axis horizontal and extending partially through said slot with its axis in said housing.

5. The assembly as defined in claim 3 wherein said leveling system includes motion sensing means for determining the distance of rotation of one said down pulley of each said lifting means and providing an output signal indicative of such measured distance of rotation.

6. The assembly as defined in claim 5 wherein said leveling system further includes control circuit means for receiving said output signals for operating said hydraulic control means in response to the difference between said output signals.

7. The assembly as defined in claim 1 wherein each said piston pulley block includes three piston pulleys, each said piston pulley being mounted horizontally to dispose an axis of rotation of respective said piston pulley vertically.

8. The assembly as defined in claim 1 wherein said leveling system further includes motion-sensing means for determining the amount of vertical movement of each lifting means and providing an output signal indicative of such measured movement.

9. The assembly as defined in claim 8 wherein said leveling system further includes control means for receiving said output signals for operating said hydraulic control means in response to said output signals.

10. The assembly as defined in claim 1 further including three spaced redirect pulleys mounted in a fixed position on each said housing, each cable having one end portion affixed with respect to said housing and another end portion affixed to said pulley block, three cradle pulleys mounted on each said side of said cradle, each said cable being threaded around said pulley block and a respective said redirect pulley and respective said cradle pulley to provide that said cradle moves one and one half times the distance of movement of said pulley block by said hydraulic lifting means.

11. An assembly for lifting a boat comprising a cradle for carrying a boat;

three vertically disposed and spaced pilings on each side of said cradle having a lower portion mounted into a floor of a body of water and an upper portion extending thereabove;

a pair of elongate support housings each affixed to and supported by said upper portion extending thereabove;

a pair of elongate support housings each affixed to and supported by said upper portion of each respective said piling;

a pair of independently controlled hydraulic lifting means respectively housed in and mounted on a said respective support housing and connected to said cradle for moving said cradle vertically;

each said lifting means including a horizontally extensible piston carrying a piston pulley block and a portion of each said cable to dispose said another end portion of each said cable vertically for moving said cradle upwardly and downwardly when said piston pulley block is moved horizontally by said piston; and hydraulic control means for operating each said hydraulic cylinder said hydraulic control means including automatic leveling system for maintaining said cradle level from port to starboard when said cradle is moved vertically by said pair of hydraulic lifting means.

12. The assembly as defined in claim 11 wherein said cradle includes three spaced structural members having opposite end portions and extending laterally of said cylinder and piston, each said cable having a first end attached to a respective said end portion of respective said member and another end portion threaded around said piston pulley block and affixed to said housing.

13. The assembly as defined in claim 11 wherein each said piston pulley block includes three piston pulleys, each said piston pulley being mounted horizontally to dispose and axis of rotation of said piston pulley vertically.

14. The assembly as defined in claim 11 wherein each said transition pulley means includes a down bow pulley, a down amidships pulley, and a down stern pulley, each said down pulley being disposed vertically to dispose an axis of rotation of said down pulley horizontally.

15. The assembly as defined in claim 14 wherein said leveling system includes motion sensing means for determining the distance amount of rotation of one of said down pulleys of each said lifting means and providing an output signal indicative of such measured rotation.

16. The assembly as defined in claim 15 wherein said leveling system includes control circuit means for receiving each said output signal for operating said hydraulic control means in response to control signals based on the difference between said output signals.

17. The assembly as defined in claim 11 wherein said leveling system includes motion sensing means for determining the amount of vertical movement of each lifting means and providing an output signal indicative of such measured movement.

18. The assembly as defined in claim 17 wherein said leveling system includes control means for receiving each said output signal for operating said hydraulic control means in response to the difference between said output signals.

19. The assembly as defined in claim 11 wherein each said cable is threaded around pulleys in said pulley block and connected to said cradle to provide that said cradle end of each said cable moves vertically twice the distance of the movement of said pulley block by said piston.

20. The assembly as defined in claim 11 further including three spaced redirect pulleys mounted in a fixed position on each said housing, each said cable having one end portion affixed to said cradle and another end portion affixed to said piston pulley block, each said cable being threaded around said piston pulley block and a respective said redirect pulley to provide that said cradle moves three times the distance of movement of said piston pulley block by said hydraulic lifting means.

21. An assembly for lifting a boat comprising a cradle for carrying a boat;

a plurality of spaced vertically disposed and spaced pilings on each side of said cradle;

each said piling having upper and lower end portions with said upper end portions being located above water at a predetermined height;

a pair of elongated support housings being affixed to and supported by respective said upper portion of said plurality of said pilings on each side of said cradle;

a pair of independently controlled hydraulic lifting means disposed in respective said housing for moving said cradle upwardly and downwardly;

each said hydraulic lifting means including a cylinder affixed to said housing and a movable piston;

a plurality of pulleys and a plurality of cables, said cylinder and piston moving in a substantially horizontal direction;

said cradle including a deck part substantially horizontally aligned with a dock;

and said housing having an upper wall substantially parallel to and parallel with said deck part of said cradle.

22. The assembly as defined in claim 21 wherein each said housing includes a lower wall, said plurality of pulleys including a down pulley located respectively adjacent a bow and a stern of a boat disposable on said cradle, each down pulley being mounted within respective said housings with its axis horizontal, each said lower wall of said housing including spaced slots, each said down pulley extending partially through respective said slot with its axis in said housing.

* * * * *